US006655670B1

(12) United States Patent
Liou

(10) Patent No.: US 6,655,670 B1
(45) Date of Patent: Dec. 2, 2003

(54) TRANSMISSION MECHANISM FOR CLAMPING DEVICE

(76) Inventor: Ferng-Jong Liou, No. 101, Jong Shing Rd., Sec. 2, Taichung Hsien (TW)

( * ) Notice: Subject to any disclaimer, the term of this patent is extended or adjusted under 35 U.S.C. 154(b) by 0 days.

(21) Appl. No.: 10/234,253

(22) Filed: Sep. 5, 2002

(51) Int. Cl.[7] ..... B66F 3/00
(52) U.S. Cl. ..... 269/6
(58) Field of Search ..... 269/3, 6, 143, 269/166–171.5; 222/325–327, 391; 81/487

(56) References Cited

U.S. PATENT DOCUMENTS 836,303 A * 11/1906 Christensen ..... 269/170
5,197,360 A * 3/1993 Wooster, Jr. ..... 269/170
5,709,372 A * 1/1998 Lii ..... 269/6
5,732,936 A * 3/1998 Lii ..... 269/6
5,853,168 A * 12/1998 Drake ..... 269/6
6,575,442 B2 * 6/2003 Klimach et al. ..... 269/6

* cited by examiner

*Primary Examiner*—Robert C. Watson
(74) *Attorney, Agent, or Firm*—Troxell Law Office PLLC

(57) ABSTRACT

A clamping device has a transmission mechanism that includes two operating handles connected to a scaled rod extended through and connected to a movable jaw of the clamping device. Each of the operating handles has one set of front and rear push members mounted on the scaled rod to closely locate behind the handle. A cushion made of a plastic steel material with a predetermined elasticity is disposed between each set of the front and rear push members, so as to prevent the push members from loosening from the scaled rod due to an overly large force applied on the push members via the operating handles.

1 Claim, 4 Drawing Sheets

TRANSMISSION MECHANISM FOR CLAMPING DEVICE

BACKGROUND OF THE INVENTION

The present invention relates to a transmission mechanism for clamping device, and more particularly to a transmission mechanism for clamping device having two sets of front and rear push members with one elastic plastic-steel cushion disposed between the front and the rear push member, so that the push members do not easily loosen from a scaled rod of the clamping device due to an overly large force applied on the push members via an operating handle.

FIG. 1 shows a conventional clamping device generally available in the markets. The conventional clamping device includes a transmission mechanism in which an operating handle A is pivotally turned to incline a push member E behind the operating handle A. When the push member E is inclined, an opening B thereof engaging with a scaled rod D of the clamping device also inclines to firmly contact with, press against, and push the scaled rod D, which is fixedly connected to a movable jaw C of the clamping device, so that the scaled rod D, and accordingly the movable jaw C, are shifted.

A disadvantage of the above-described transmission mechanism for the conventional clamping device is that there is only one single push member E provided behind the operating handle A, and that the push member E tends to become loosened from the scaled rod D at the opening B when an overly large force is applied on the push member E via the operating handle A. The conventional clamping device also requires an operator to hold and operate the device laboriously to cause a sore and tired hand easily.

SUMMARY OF THE INVENTION

A primary object of the present invention is to provide an improved transmission mechanism for a clamping device that can be easily operated without the risk of having push members loosened from the scalded rod due to an overly large force applied via the operating handle.

Another object of the present invention is to provide an improved transmission mechanism for a clamping device that enables an operator to handle the clamping device in an easy and laborsaving manner.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
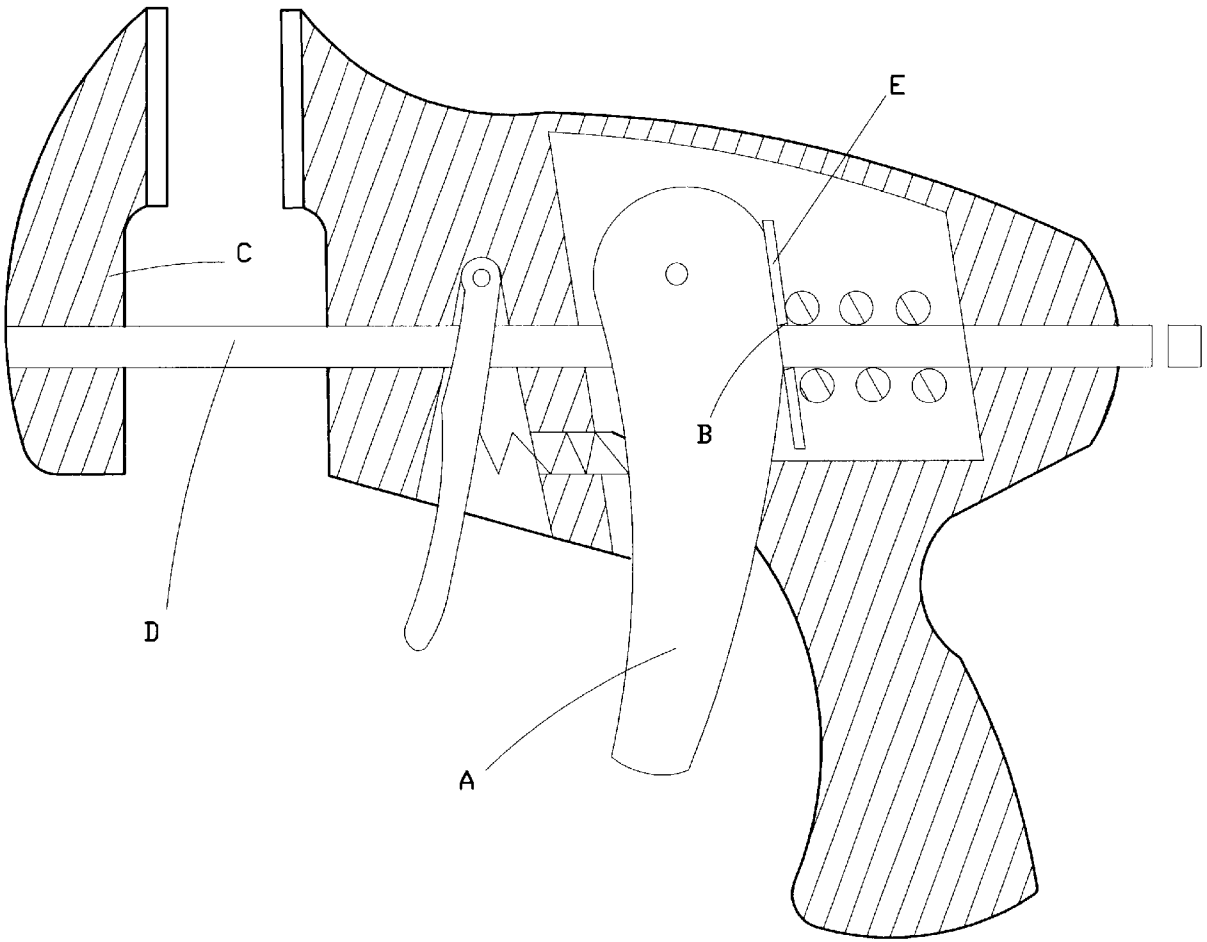
FIG 1 PRIOR ART
FIG. 1 is a partially sectioned side view of a conventional clamping device showing a transmission mechanism thereof.
Figure 2:
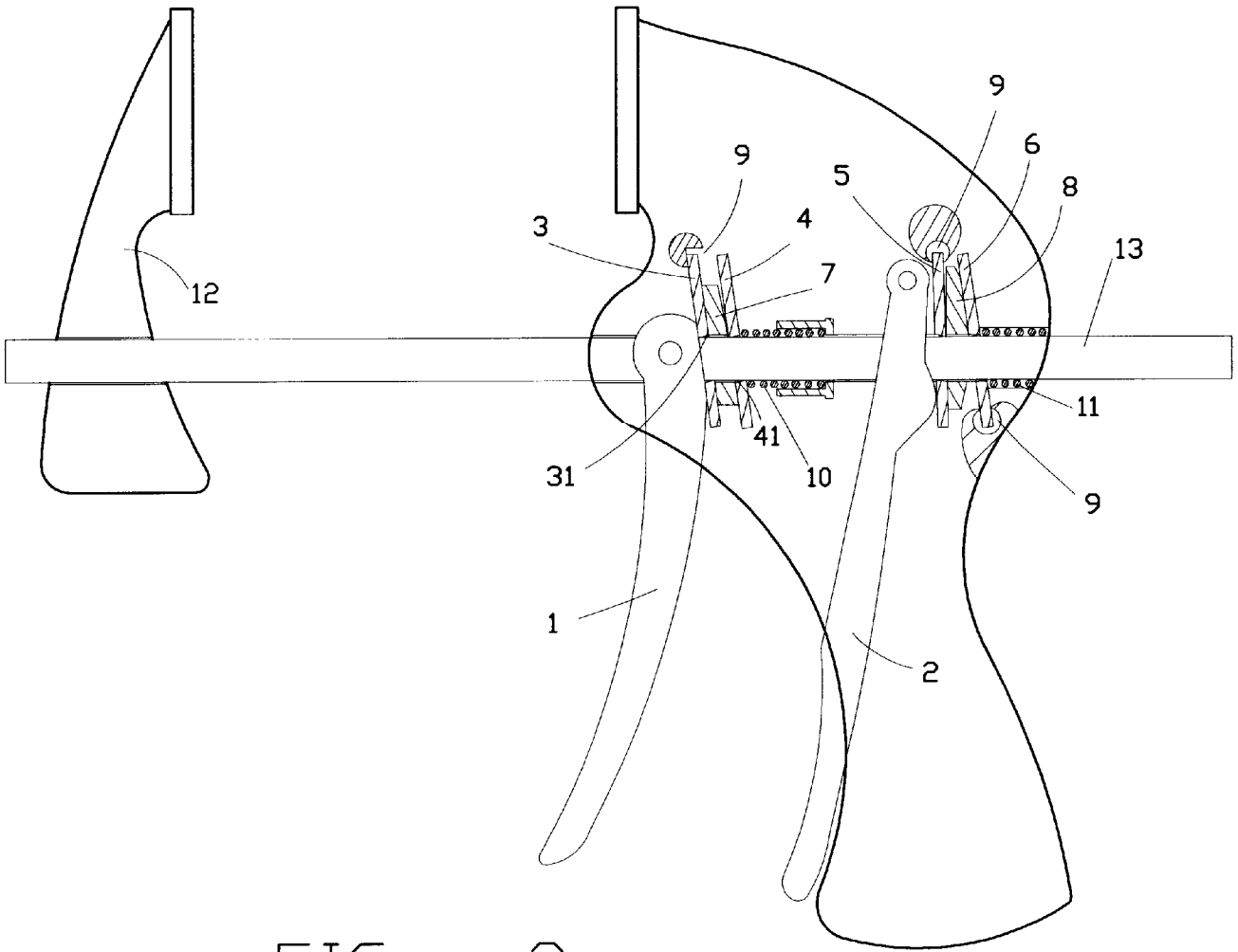
FIG. 2 is a partially sectioned side view of a clamping device according to the present invention showing a transmission mechanism thereof.

Please refer to FIG. 2 that is a partially sectioned side view of a clamping device showing a transmission mechanism according to the present invention. As shown, the clamping device and the transmission mechanism thereof includes two operating handles 1 and 2, a movable jaw 12, a scaled rod 13 extended through and connected to the movable jaw 12, and two sets of front and rear push members 3, 4 and 5, 6 mounted on the scaled rod 13 to locate behind the operating handles 1 and 2, respectively. Each set of the push members 3, 4 and 5, 6 has a plastic-steel cushion 7, 8 with a predetermined elasticity disposed therebetween. The pushing members 3, 4, 5, and 6 are respectively pivotally connected to the clamping device at pivotal points 9. The push members 3, 4 are provided with openings 31, 41 at where the push members 3, 4 are engaged with the scaled rod 13. The two rear push members 4, 6 behind the two operating handles 1, 2, respectively, are provided at respective outer side with a compression spring 10, 11 to enable the two sets of front and rear push members 3, 4 and 5, 6 to automatically return to their initial positions after they are pivotally turned.

Figure 3:
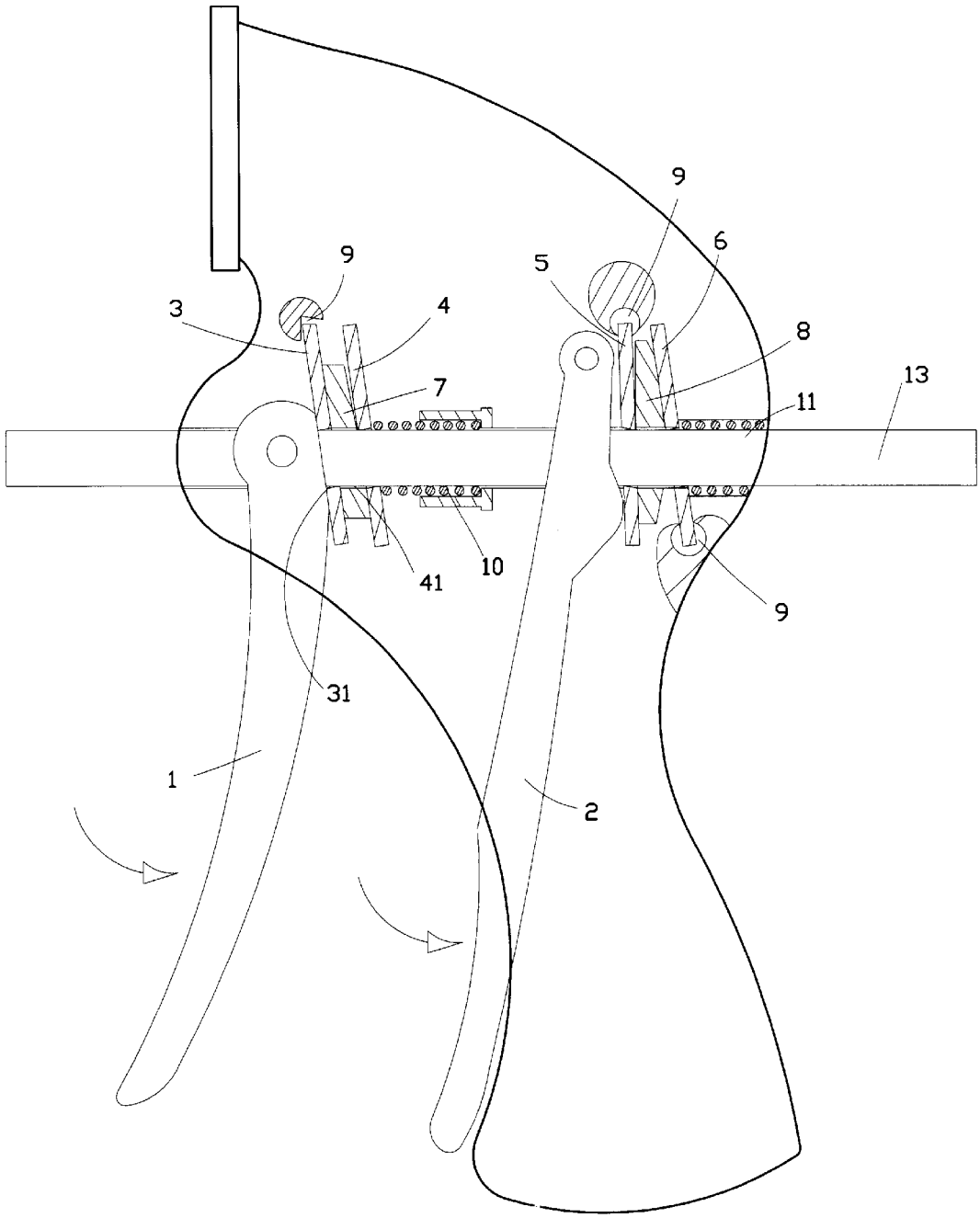
FIGS. 3 and 4 are fragmentary, enlarged, and partially sectioned side views of the clamping device of the present invention showing the operation thereof.
Figure 4:
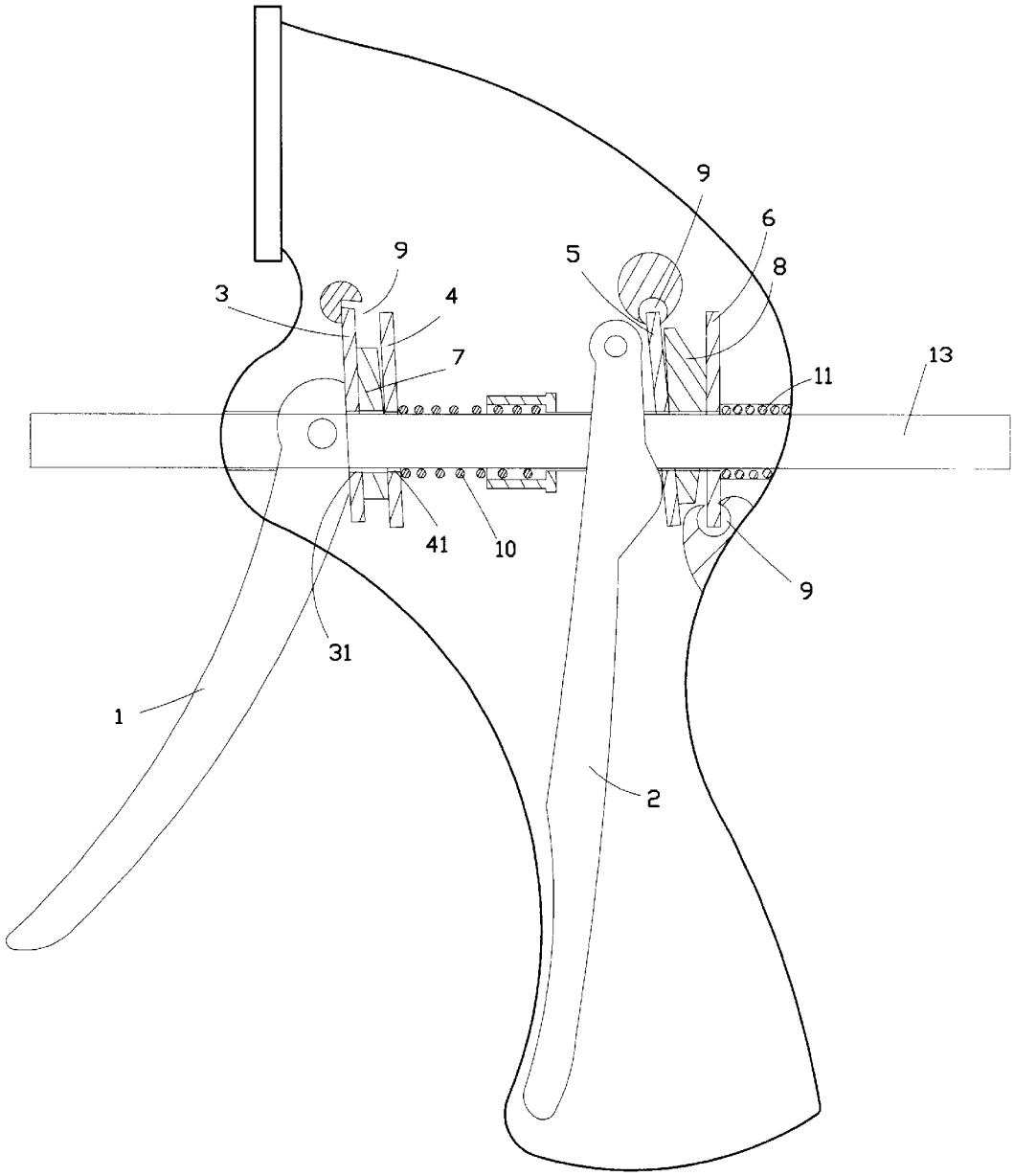

Please now refer to FIGS. 3 and 4 that are fragmentary, enlarged, and partially sectioned side views of the clamping device showing operations thereof to shift the scaled rod 13 and accordingly the movable jaw 12. When an operator holds and pulls the operating handle 1, the operating handle 1 is pivotally turned to generate a force that is transmitted to the front push member 3. The elastic plastic-steel cushion 7 buffers the force and then transmits the same from the front push member 3 to the rear push member 4, so that the openings 31, 41 of the push members 3, 4 are in an inclined position relative to the scaled rod 13. The openings 31, 41 in the inclined position cause the push members 3, 4 to tightly contact with, press against, and push the scaled rod 13 that is firmly screwed to the movable jaw 12. When the scaled rod 13 is pushed by the inclined openings 31, 41 of the push members 3, 4 to shift, the movable jaw 12 connected thereto is moved accordingly.

Since the force transmitted from the operating handle 1 to the front push member 3 is buffered at the elastic plastic-steel cushion 7 before being further transmitted to and distributed over the rear push member 4, the push members 3, 4 would not loosen from the scaled rod 13 at the openings 31, 41 due to an overly large force applied on the push members 3, 4 via the operating handle 1. Meanwhile, the operator may operate the clamping device with less effort to avoid a sore and tired hand manipulating the clamping device.

What is claimed is:

1. A transmission mechanism for clamping device, said clamping device including a movable jaw, and a scaled rod fixedly connected to said movable jaw to extend therethrough, said transmission mechanism comprising two operating handles connected to said scaled rod at predetermined positions, and two sets of front and rear push members mounted on said scaled rod to separately locate behind said two operating handles; a cushion made of a plastic steel material having a predetermined elasticity being disposed between each set of said front and rear push members, each said push member being connected to said clamping device at a pivotal point, and each of said rear push members being provided at an outer side with a compression spring to automatically push each said set of push members to an initial position when said push members have been shifted via said operating handles.

* * * * *